US007658460B2

(12) United States Patent
Aoki

(10) Patent No.: US 7,658,460 B2
(45) Date of Patent: Feb. 9, 2010

(54) PRINTING APPARATUS, METHOD, AND PROGRAM COMPRISING A PLURALITY OF PRINTER UNITS USING SYNCHRONIZED, DIVIDED PRINT DATA

(75) Inventor: Akio Aoki, Mitsukaido (JP)

(73) Assignee: Canon Finetech Inc., Misato-shi (JP)

( * ) Notice: Subject to any disclaimer, the term of this patent is extended or adjusted under 35 U.S.C. 154(b) by 422 days.

(21) Appl. No.: 11/193,401

(22) Filed: Aug. 1, 2005

(65) Prior Publication Data

US 2006/0033764 A1 Feb. 16, 2006

(30) Foreign Application Priority Data

Aug. 6, 2004 (JP) ..... 2004-231100

(51) Int. Cl.
*B41J 29/38* (2006.01)
*B41J 2/155* (2006.01)
*B41J 2/21* (2006.01)

(52) U.S. Cl. ..... 347/13; 347/42; 347/43

(58) Field of Classification Search ..... 347/9, 347/13, 42
See application file for complete search history.

(56) References Cited

U.S. PATENT DOCUMENTS

| | | | | | |
|---|---|---|---|---|---|
| 4,721,968 | A * | 1/1988 | Arai et al. | ..... | 347/42 |
| 4,774,524 | A * | 9/1988 | Warbus et al. | ..... | 346/44 |
| 4,963,882 | A * | 10/1990 | Hickman | ..... | 347/43 |
| 5,565,900 | A * | 10/1996 | Cowger et al. | ..... | 347/42 |
| 5,581,284 | A * | 12/1996 | Hermanson | ..... | 347/43 |
| 5,587,730 | A * | 12/1996 | Karz | ..... | 347/13 |
| 6,084,609 | A * | 7/2000 | Manini et al. | ..... | 347/42 |
| 6,155,669 | A * | 12/2000 | Donahue et al. | ..... | 347/42 |
| 6,663,222 | B2 * | 12/2003 | Verhoest et al. | ..... | 347/42 |
| 6,783,209 | B2 | 8/2004 | Gompertz | | |
| 6,997,698 | B2 * | 2/2006 | Silverbrook | ..... | 425/375 |
| 7,021,738 | B2 * | 4/2006 | Juan et al. | ..... | 347/19 |

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

High-density image printing can be achieved by using ink jet print heads capable of ejecting ink. A plurality of same color print heads capable of ejecting the same color ink are controlled according to the same print data. Drive timings for the same color print heads are so set that the dots printed by these same color print heads overlap each other.

12 Claims, 13 Drawing Sheets

PRINTING APPARATUS, METHOD, AND PROGRAM COMPRISING A PLURALITY OF PRINTER UNITS USING SYNCHRONIZED, DIVIDED PRINT DATA

The application claims priority from Japanese Patent Application No. 2004-231100 filed on Aug. 6, 2004, which is incorporated herein by reference.

BACKGROUND OF THE INVENTION

1. Field of the Invention

The present invention relates to a printing apparatus, a printing system, a printing method and a program to print images using a plurality of print heads capable of ejecting ink.

2. Description of the Related Art

Printing very few kinds of materials in large quantities, as in pamphlet printing and corrugated cardboard printing, has conventionally been performed using an offset printing machine and a flexographic printing machine. These printing machines (printing apparatus) require a printing plate for each print job and thus the printing plate must be replaced and ink cleaning done every time the print job is changed. Thus, if these printing machines are used for many-kinds-in-small-lots printing, a unit printing cost increases. Further, inserting a small-lot print job in a large-lot print job in a printing operation using these printing machines will result in a significant fall in efficiency. Further, since the content of printing is fixed by the printing plate, it is impossible to print variable data.

Japanese Patent Application Laid-open No. 2001-331009 discloses a tandem type color printer which prints a color image on a print medium by transferring multicolor toner images formed on a plurality of photosensitive drums onto the print medium. This color printer has a construction for high-speed printing of a single-color image. That is, a toner image of the same color is divided and formed on a plurality of photosensitive drums and these divided toner images are transferred onto the print medium. This method splits the printing operation of a single-color image among the plurality of photosensitive drums.

As the IT technology has advanced in recent years, there is a growing call, as a general trend, for improved services specifically targeted at individual consumers. The printing field is no exception. In a direct mail printing classified in a form printing field, for example, there are increasing needs for variable data printing which prints information (names, addresses, etc.) on destinations (individuals) and advertising information properly focused on the destinations (individuals) in addition to a common information portion. In a corrugated cardboard printing field also, needs are growing for variable data printing which, in addition to printing a common design on all corrugated cardboards, prints manufacturer information (variable data) and serial number for each board in a large-lot printing or small-lot printing run. Further, in an interior material (e.g., wall paper) printing field, there is a growing trend for a small-lot printing that can meet a variety of preferences of end users, rather than printing a single, uniform design.

Against this background, ink jet printing apparatus that require no printing plates and print job changing preparations and which can print variable data are becoming popular.

However, although the ink jet printing apparatus can produce a satisfactory image quality when a print medium is dedicated paper such as coated paper, if such dedicated paper cannot be used, a required level of image quality may not necessarily be obtained.

For example, when an ink jet printing apparatus is employed in the form printing and conventional offset printing paper is used, there is a possibility of the print density becoming insufficient. Further, if the ink jet printing apparatus is employed in a corrugated cardboard printing, since ink dedicated for the ink jet printing apparatus soaks into cardboard quickly, the print density may become undesirably low. In the wall paper printing, although a light tone is desired, it is currently difficult to realize a desired color reproduction capability with the ink jet printing apparatus.

Further, there is available an ink jet printing apparatus of a serial scan type which forms an image by alternately repeating an operation that moves a print head in a main scan direction as it ejects ink and another operation that feeds the print medium in a subscan direction crossing the main scan direction. Some of this type of ink jet printing apparatus employ a multipass printing system that prints a predetermined width of print area on a print medium in a plurality of scans of the print head. This multipass printing system allocates a plurality of pixels on one raster along the main scan direction to a plurality of ink ejection nozzles of the print head so that pixels on one raster are formed by ink droplets ejected from different nozzles. This printing method can suppress adverse effects caused by nozzle variations and thereby print high-quality images. However, as the number of print head scans increases, the printing speed decreases significantly.

SUMMARY OF THE INVENTION

This invention can provide a printing apparatus, a printing system, a printing method and a program which can print a high-densisty image by using ink jet print heads capable of ejecting ink.

Viewed from one aspect the present invention provides a printing apparatus for printing an image on a print medium by using a plurality of ink jet print heads shifted in position from each other in a transport direction of the print medium and driving the plurality of print heads according to print data to eject ink as the print medium is transported;

wherein the plurality of print heads include a plurality of same color print heads capable of ejecting the same color ink;

wherein the printing apparatus comprises:

a high-density print mode control unit to drive each of the plurality of the same color print heads to eject ink according to the same print data; and a high-density print mode setting unit to set drive timings at which the plurality of the same color print heads are driven by the high-density print mode control unit in such a manner that image portions printed by the plurality of the same color print heads overlap each other.

Another aspect of the present invention provides a printing system which includes: a printing apparatus for printing an image on a print medium by using a plurality of ink jet print heads shifted in position from each other in a transport direction of the print medium and driving the plurality of print heads according to print data to eject ink as the print medium is transported; and a host device to supply the print data to the printing apparatus;

wherein the plurality of print heads include a plurality of same color print heads capable of ejecting the same color ink;

wherein the printing apparatus comprises:

a high-density print mode control unit to drive each of the plurality of the same color print heads to eject ink according to the same print data; and a high-density print mode setting unit to set drive timings at which the plurality of the same color print heads are driven by the high-density print mode control unit in such a manner that image portions printed by the plurality of the same color print heads overlap each other;

wherein the host device has means for supplying the same print data to the plurality of the same color print heads.

Still another aspect of the present invention provides a printing method for printing an image on a print medium by using a plurality of ink jet print heads shifted in position from each other in a transport direction of the print medium and driving the plurality of print heads according to print data to eject ink as the print medium is transported;

wherein the plurality of print heads include a plurality of same color print heads capable of ejecting the same color ink;

the printing method comprising the steps of:

driving each of the plurality of the same color print heads to eject ink according to the same print data; and setting drive timings at which the plurality of the same color print heads are driven by the high-density print mode control unit in such a manner that image portions printed by the plurality of the same color print heads overlap each other.

Yet another aspect of the present invention provides a program for controlling a printing apparatus to print an image on a print medium by using a plurality of ink jet print heads shifted in position from each other in a transport direction of the print medium and driving the plurality of print heads according to print data to eject ink as the print medium is transported;

wherein the plurality of print heads include a plurality of same color print heads capable of ejecting the same color ink;

the program causing a computer to execute:

a step of driving each of the plurality of the same color print heads to eject ink according to the same print data; and a step of setting drive timings at which the plurality of the same color print heads are driven in such a manner that image portions printed by the plurality of the same color print heads overlap each other.

With this invention, a plurality of same color print heads capable of ejecting the same color ink are controlled based on the same print data, and the drive timings at which to drive these same color print heads are so set that the image portions printed by the same color print heads will overlap each other. This arrangement allows high-density images to be formed by the ink dots of the same color overlapping each other.

Further, the drive timings for the plurality of the same color print heads can reliably be set according to a synchronization signal corresponding to the transport speed of the print medium and the positional relation of the plurality of the same color print heads in the transport direction of the print medium.

Further, by providing a set of the same color print heads for each of the plurality of color inks, it is possible to print not only high-density single-color images but also high-density color images.

Further, by controlling the plurality of the same color print heads according to the print data which is allocated in units of raster columns to these same color print heads and by setting the drive timings for these same color print heads such that the image portions printed by them will supplement each other to complete an image, the image can be printed at high speed. Also by providing a set of the same color print heads for each of the color inks, it is possible to print at high speed not only single-color images but also color images.

For example, according to the print mode, it is possible to realize a fast, high-quality printing of variable data and a superfast, single-color printing (monochrome printing). This is particularly suited for industrial printing apparatus.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described by referring to the accompanying drawings.

First Embodiment

Figure 1:
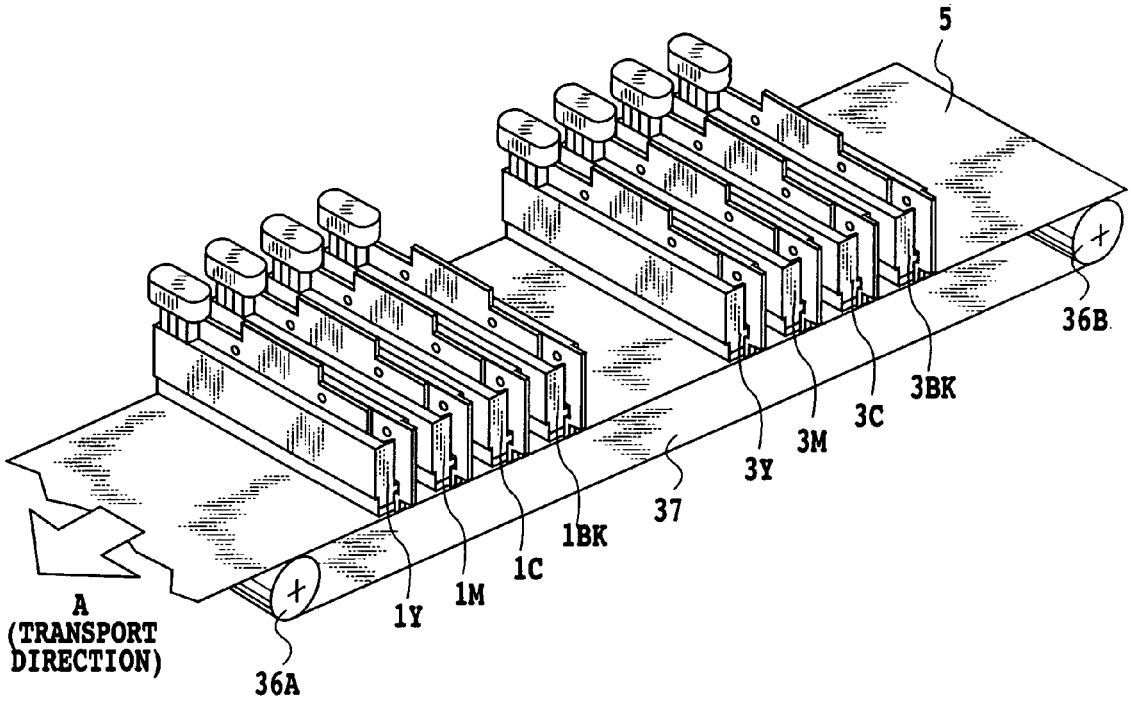
FIG. 1 is an outline perspective view showing an essential part of a printing apparatus in a first embodiment of this invention.
Figure 2:
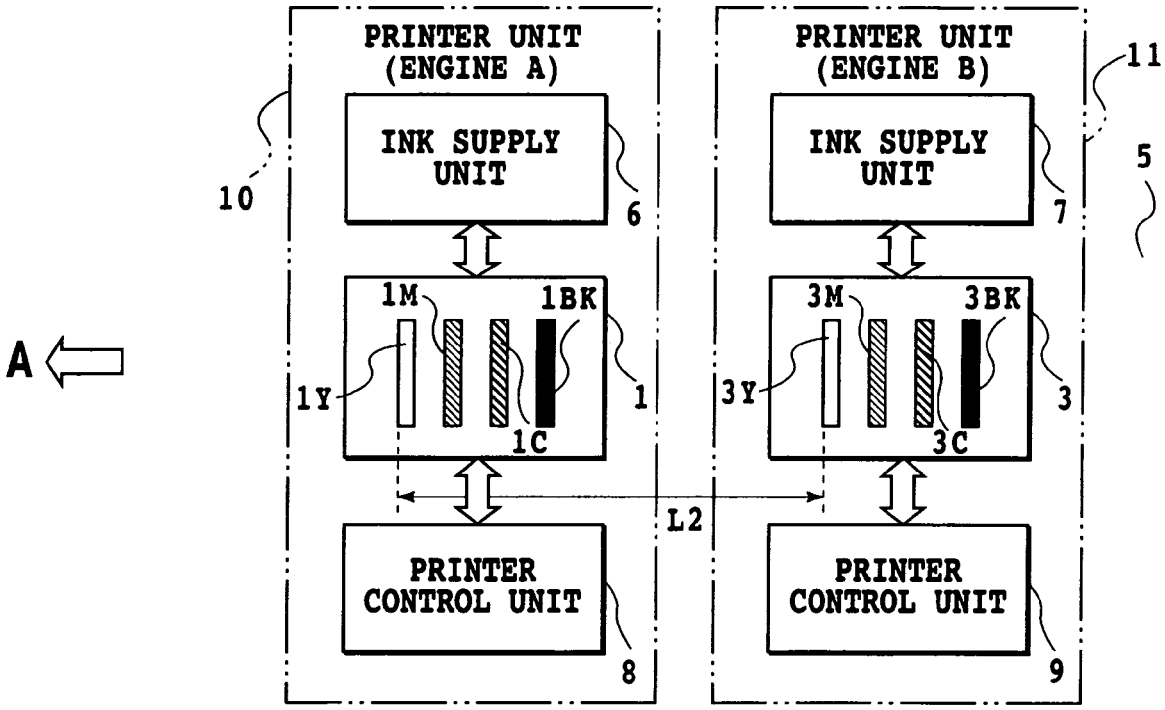
FIG. 2 is a block diagram of an image printing unit in the printing apparatus of FIG. 1.
Figure 3:
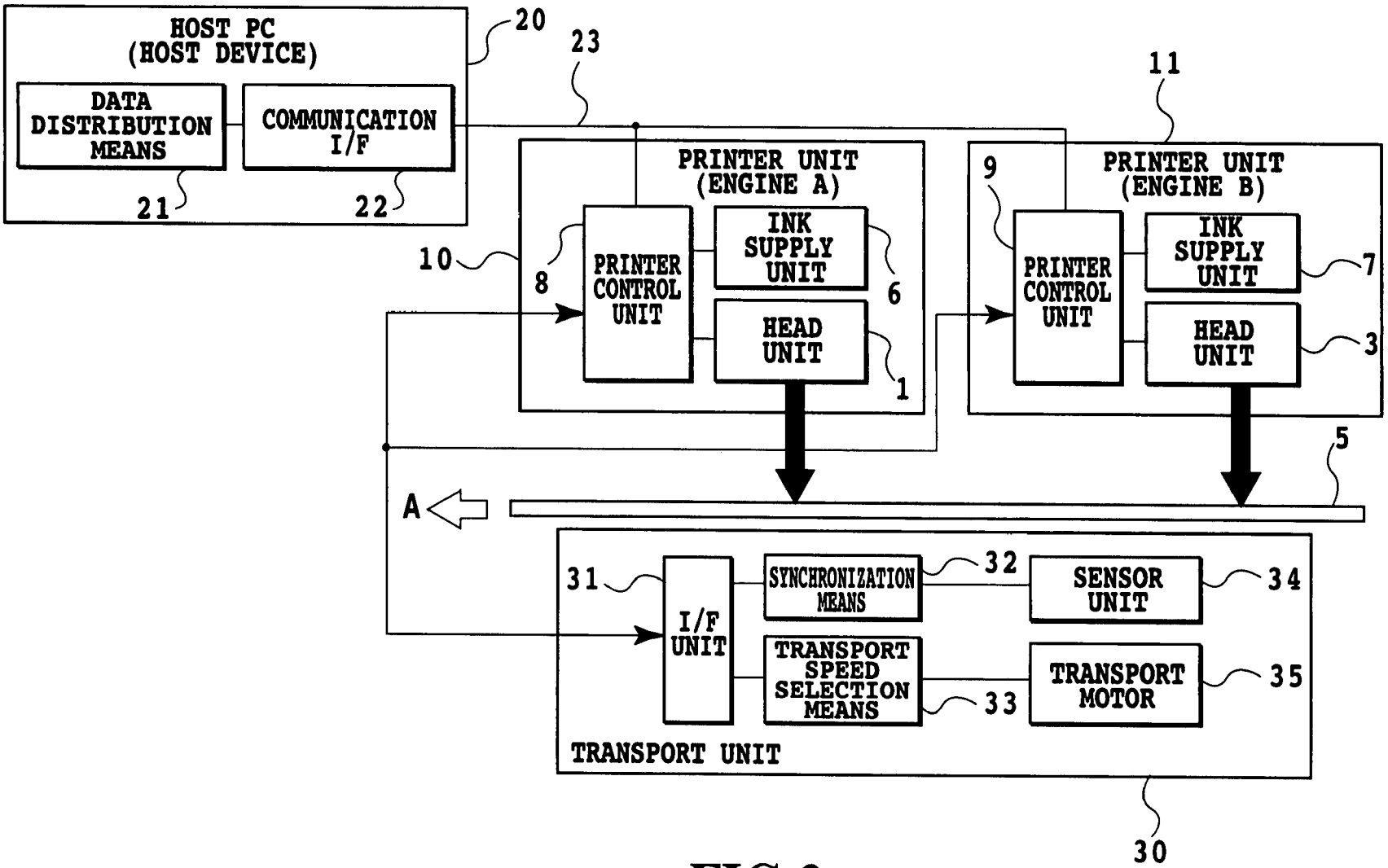
FIG. 3 is a block diagram of a control system in the printing apparatus of FIG. 1.

FIG. 1 is an outline perspective view showing an essential portion of the printing apparatus of this embodiment. FIG. 2 is a block diagram of an image printing unit in the printing apparatus of FIG. 1. FIG. 3 is a block configuration diagram showing a control system of the printing apparatus of FIG. 1. The printing apparatus of this embodiment, as shown in FIG. 3, has two independent printer units (also referred to as "engine A, B") 10, 11 and a transport unit 30 and, together with a host device in the form of a personal computer (also referred to as a "host PC"), forms a printer composite system (printing system).

The printer unit 10 includes a head unit 1, an ink supply unit 6 and a printer control unit 8. The head unit 1 has four print heads (also referred to as line heads) 1Y, 1M, 1C, 1Bk removably mounted thereon and extending in a direction crossing a transport direction A of a print medium 5 (in this example, a direction perpendicular to the transport direction A). Each of the print heads 1Y, 1M, 1C, 1Bk is formed with nozzles arrayed in a column along its length (in a direction in which the print head extends). Each of the nozzles can eject ink. A variety of ink ejection systems may be used, including those using electrothermal transducers (heaters) and piezoelectric elements. When electrothermal transducers are used, for example, thermal energy generated by the electrothermal transducers forms bubbles in ink and the pressure of expanding bubbles expels ink droplets from the nozzles. The print heads 1Y, 1M, 1C, 1Bk are arranged so that their nozzle columns are spaced at equal intervals in the transport direction of arrow A. The print head 1Y ejects a yellow ink, the print head 1M a magenta ink, the print head 1C a cyan ink, and the print head 1Bk a black ink. These inks are supplied from an ink supply unit 6. The head unit 1 is connected with the printer control unit 8 for the control of its operation.

The printer unit 11 is constructed in a similar way. It includes a head unit 3 incorporating print heads 3Y, 3M, 3C, 3Bk for ejecting yellow, magenta, cyan and black ink respectively. It also includes an ink supply unit 7 and a printer control unit 9.

In the head units 1, 3, the print heads 1Y, 1M, 1C, 1Bk and the print heads 3Y, 3M, 3C, 3Bk are arranged in the same order in the transport direction indicated by arrow A. The first print head group and the second print head group are spaced a predetermined distance L2 in the transport direction of arrow A. The print heads 1Y, 3Y are assigned a yellow ink; the print heads 1M, 3M a magenta ink; the print heads 1C, 3C a cyan ink; and the print heads 1Bk, 3Bk a black ink. Thus, in this example, four sets of paired print heads, each set assigned one and the same ink color, are prepared.

The host PC 20 has a data distribution means 21 which is connected to the printer control units 8, 9 of the printer units 10, 11 through a communication interface 22 (e.g., USB 2.0 interface). The printer control units 8, 9 are connected to an interface 31 of the transport unit 30.

The transport unit 30 drives a transport motor (actuator for feeding a print medium) 35 by a transport speed selection means 33 according to information on the print mode (including a high-speed print mode and a high-density print mode, both detailed later) received via the interface 31. The print medium 5 is therefore fed in the direction of arrow A at a predetermined speed according to the print mode. In this example, as shown in FIG. 1, at least one of rollers 36A, 36B around which a transport belt 37 is wound is driven by the transport motor 35 to feed the print medium 5 together with the transport belt 37 in the direction of arrow A. The transport unit 30 also has a sensor unit 34 and synchronization means 32.

[Basic Operation of Printer Unit]

Next, a basic operation of the printer units 10, 11 will be explained.

The head units 1, 3 include, in addition to the print heads, a head holder unit and a recovery conduit unit, both not shown, which assume the following three positions described below according to the state of the printing apparatus.

(1) Capping Position

While the power is off or during standby, the nozzle face of each print head (a surface of the print head in which nozzles are formed) is capped with a rubber cap of the recovery conduit unit to protect against being dried and against dirt.

(2) Wiping Position

The print head is moved to the wipe position where the recovery conduit unit is slid to wipe off ink adhering to the nozzle face of the print head by a blade of the recovery conduit unit.

(3) Printing Position

The recovery conduit unit is retracted to a predetermined position and the print head is lowered so that the nozzle face of the print head opposes a print surface of the print medium 5 with a predetermined gap therebetween. At this printing position the print head facing the print medium 5 prints an image by ejecting ink from its nozzles.

An ink supply unit of this example has subtanks accommodating inks of respective colors and, from these subtanks, inks are supplied to the corresponding print heads. The subtanks are replenished with inks from main tanks of cartridge type (also called "ink cartridges"). A replenishing of inks from the main tanks to the subtanks, a supplying of inks from the subtanks to the print heads, an ink circulation within the print heads, and a recovery of waste ink collected in the recovery conduit unit are performed through associated tubes.

The subtanks temporarily store inks and supply them to the print heads to form a meniscus in each nozzle of the print head so that the ink in each nozzle has an appropriate surface tension. Ink paths between the subtanks and the print heads have a valve to supply and circulate ink and a filter to remove dirt. The supply and circulation of ink are performed by a pump not shown.

This ink supply system has the following four operation modes.

(1) Standby/Print Mode

Supplying ink from subtanks to the print heads.

(2) Ink Supply Mode

Supplying ink from the main tanks to the subtanks.

(3) Circulation/Recycle Mode

Circulating ink between the subtanks and the print heads.

(4) Pressure Mode

Circulating ink under pressure from the subtanks to the print heads.

The printer control unit receives a variety of printer control commands and print data from the host PC and controls the position of the head unit and the operation mode of the ink supply unit. Then, in combination with the synchronization control of the transport unit described later, the printer control unit causes the printer unit to print an image on the print medium based on the print data.

[High-Speed Print Mode]

Next, the operation performed when the host PC 20 sets a high-speed print mode will be explained. In the high-speed print mode, the print heads of the same color ink are controlled according to print data that is assigned to one raster at a time as described later. The drive timings of the print heads of the same color ink are so set that image portions printed by these print heads supplement each other to form a complete image. A function unit of the former drive control is also referred to as a "high-speed print mode control unit" and a function unit for setting the latter drive timing is also referred to as a "high-speed print mode setting unit".

The transport unit 30 receives a control command for the high-speed print mode via the interface 31 and, according to the command, switches the transport speed selection means 33. Then, the transport motor 35 is driven to feed the print medium 5 at a predetermined speed V for high-speed printing.

Figure 4:
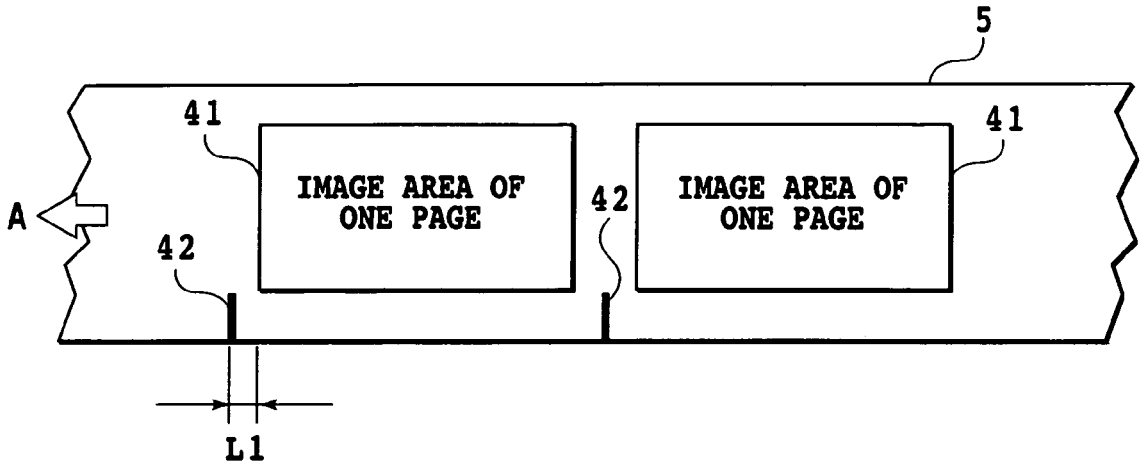
FIG. 4 is an explanatory diagram showing image areas on a print medium on which images are printed by the printing apparatus of FIG. 1.
Figure 5:
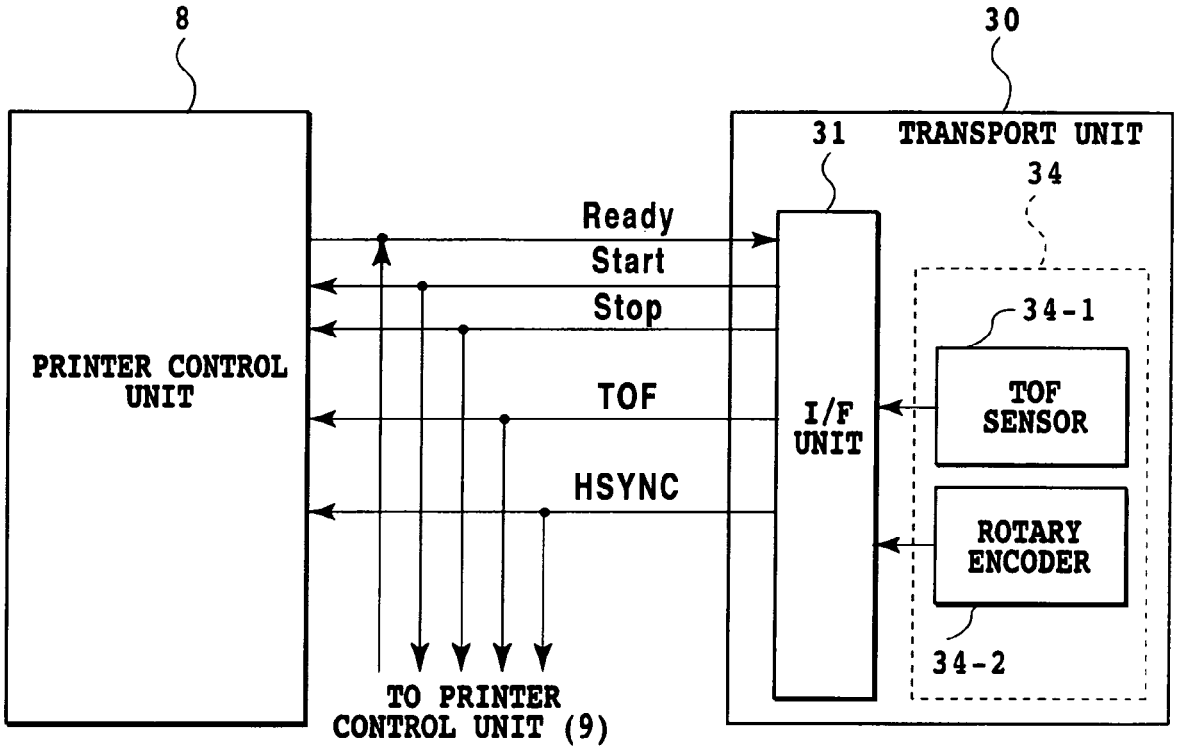
FIG. 5 is an explanatory diagram showing signals transferred between a printer control unit and a transport unit in FIG. 3.

The sensor unit 34 of the transport unit 30, as shown in FIG. 5, includes a TOF sensor 34-1 and a rotary encoder 34-2. The TOF sensor 34-1 is located at a position facing the print medium 5 and reads a mark 42 formed on the print medium 5 in advance as shown in FIG. 4. The mark 42 represents a reference position on the print medium 5 for an image area 41 of one page to be printed. The mark 42 is shifted from each image area in the direction of arrow A by a distance L1. The sensor unit 34, when it detects the mark, outputs a TOF (top of form) signal. The rotary encoder 34-2 is fitted to one of shafts of the rollers 36A, 36B and outputs a signal representing a transport speed of the print medium 5. The synchronization means 32 generates a synchronization signal HSYNC for operating the printer units 10, 11 synchronously and sends it to the printer control units 8, 9 via the interface 31. In this example, the TOF signal and the HSYNC signal are high-active signals.

In FIG. 5, a Start signal (in this example, a low-active signal) is initiated by an operator to activate the printer units 10, 11. A Stop signal (in this example, a high-active signal) stops the printer units 10, 11 when the printing operation is finished or in the event of anomaly of the transport unit 30. A Ready signal (in this example, a low-active signal) informs the transport unit 30 that the printer units 10, 11 are ready to operate, waiting for the print medium 5 to be fed. These signals are transferred between the interface 31 of the transport unit 30 and the printer control units 8, 9. The TOF signal and the HSYNC signal are transmitted from the interface 31 of the transport unit 30 to the printer control units 8, 9.

The host PC 20 generates image data for high-speed printing.

Figure 6:
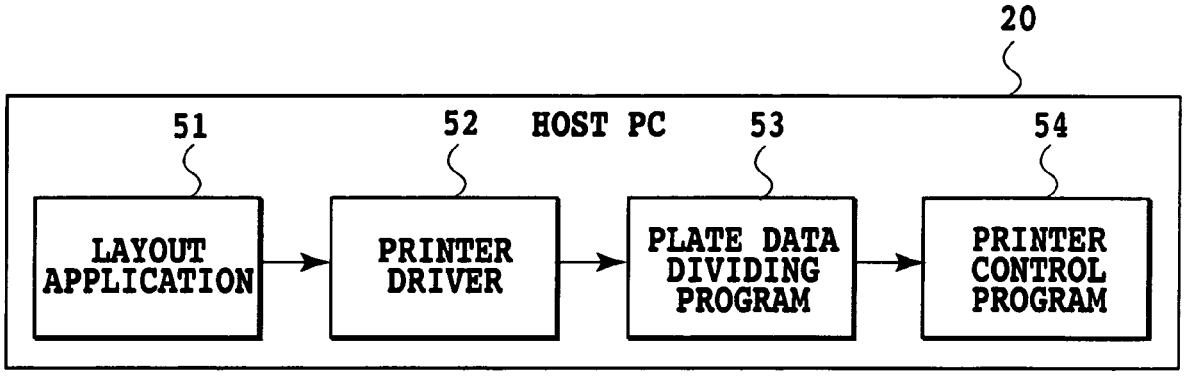
FIG. 6 is a diagram showing a software configuration of a host PC of FIG. 3.

First, layout application program 51 of FIG. 6 determines a layout of a final image to be output. Image data whose layout has been determined is converted by a printer driver 52 from RGB data into YMCK data corresponding to color inks of Y (yellow), M (magenta), C (cyan) and B (black), as in the conventional color ink jet printing apparatus. The YMCK data is further converted into bit map information that allows the printer control unit to cause the print heads to eject ink from their nozzles. In practice, since a tone is created by binary data that represents whether or not ink should be ejected from each nozzle, multivalue processing such as error diffusion is performed. This processing, however, is not a main point of this invention and its explanation is therefore omitted.

Figure 7:
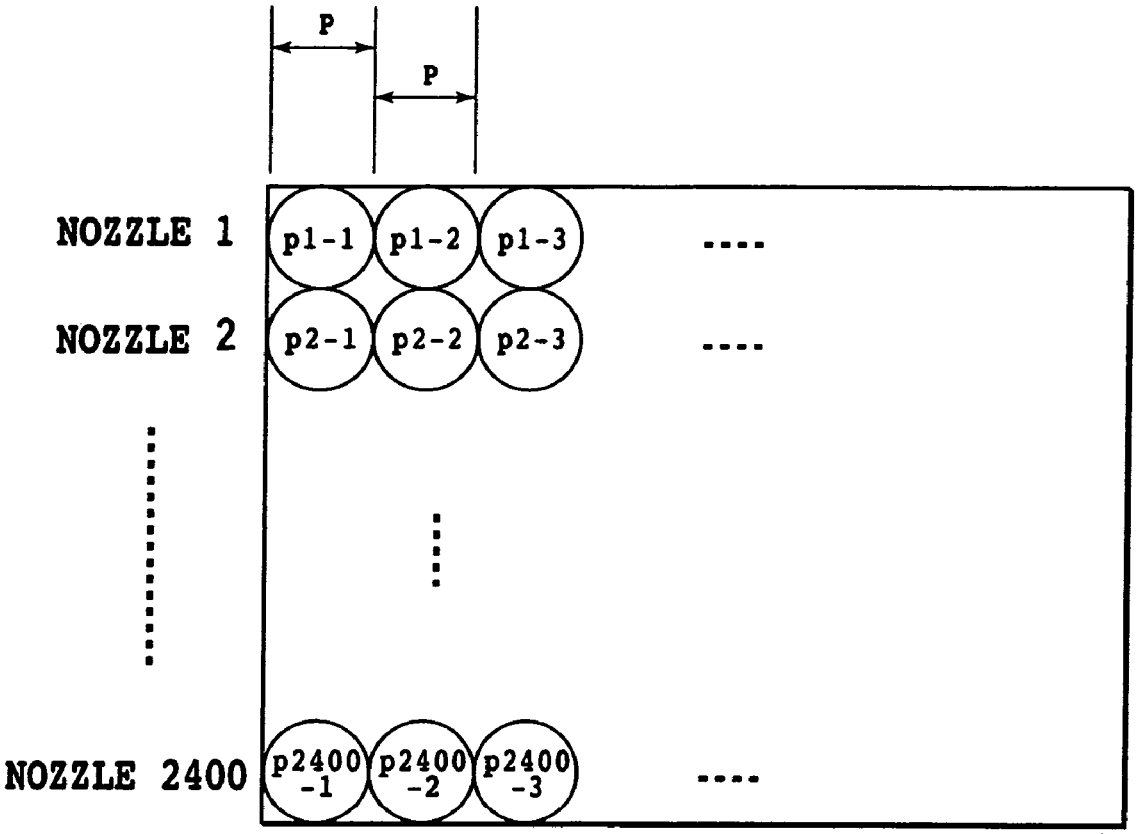
FIG. 7 is an explanatory diagram showing bit map data corresponding to one ink color.

FIG. 7 shows converted bit map data that corresponds to one ink color. This bit map data is, for example, Y data associated with a yellow ink. Data for other color inks also have the similar arrangement. In this example, a 4-inch print head is used which is formed with 2400 nozzles (nozzle 1 to nozzle 2400) that correspond to a dot resolution of 600 dpi. The bit map data is generated so as to correspond to these nozzles. Data string p1-1, p1-2, p1-3, . . . is assigned a nozzle 1, data string p2-1, p2-2, p2-3, . . . is assigned a nozzle 2 and so on. The data string p2400-1, p2400-2, p2400-3, . . . is assigned a nozzle 2400.

This bit map data is divided by plate data dividing program 53 (see FIG. 6) so that it can be printed using two printer units 10, 11. The plate data dividing program 53 functions as the data distribution means 21 of FIG. 3.

Figure 8:
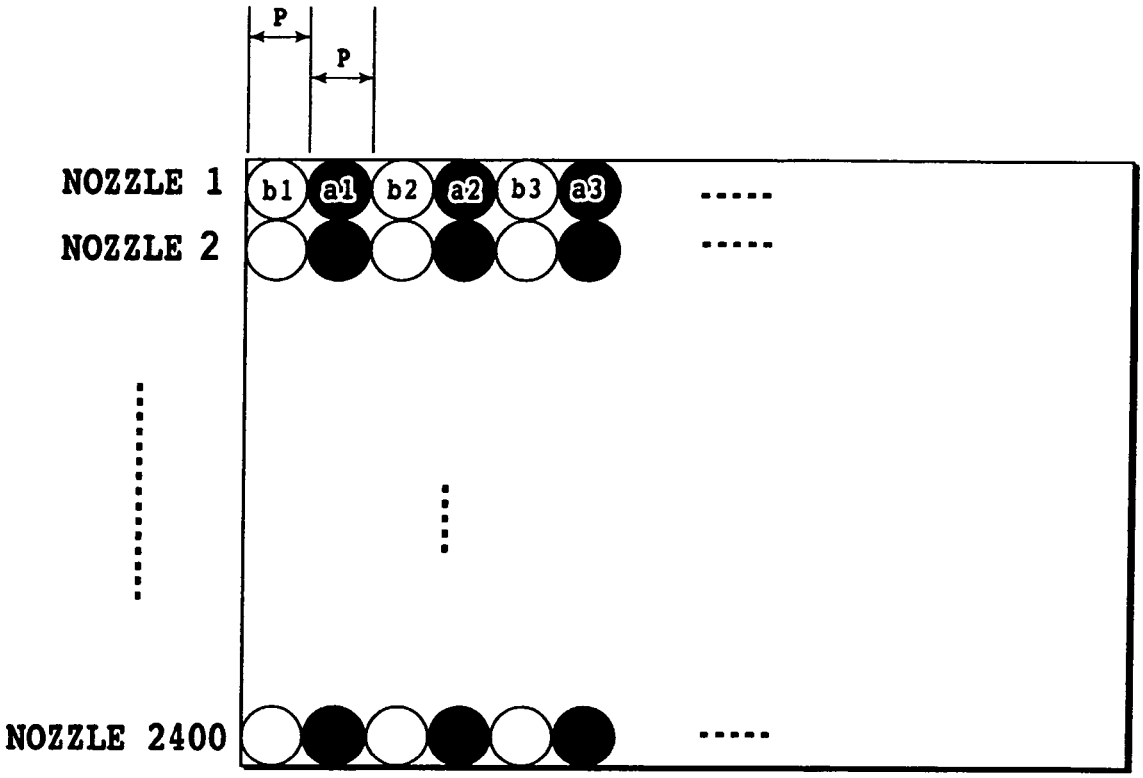
FIG. 8 is an explanatory diagram showing division processing executed by plate data dividing software of FIG. 6 during a high-speed print mode.

That is, every other data of the data string p1-1, p1-2, p1-3, . . . in FIG. 7 corresponding to nozzle 1 is assigned alternately to the printer unit 10 and the printer unit 11 as shown in FIG. 8 and, as a result, the data string p1-1, p1-2, p1-3, . . . is divided into data string a1, a2, a3, . . . for the printer unit 10 and data string b1, b2, b3, . . . for the printer unit 11. This also applies similarly to the data strings corresponding to the nozzle 2 to nozzle 2400 and their explanations are omitted. The data strings divided as described above are sent by a printer control program 54 (see FIG. 6) to the printer control units 8, 9 of the printer engine units 10, 11 through the communication interface 22. The printer control units 8, 9 rasterize bit map data of the received, divided data strings in an image memory not shown and wait for a print start command from an operator.

Figure 9:
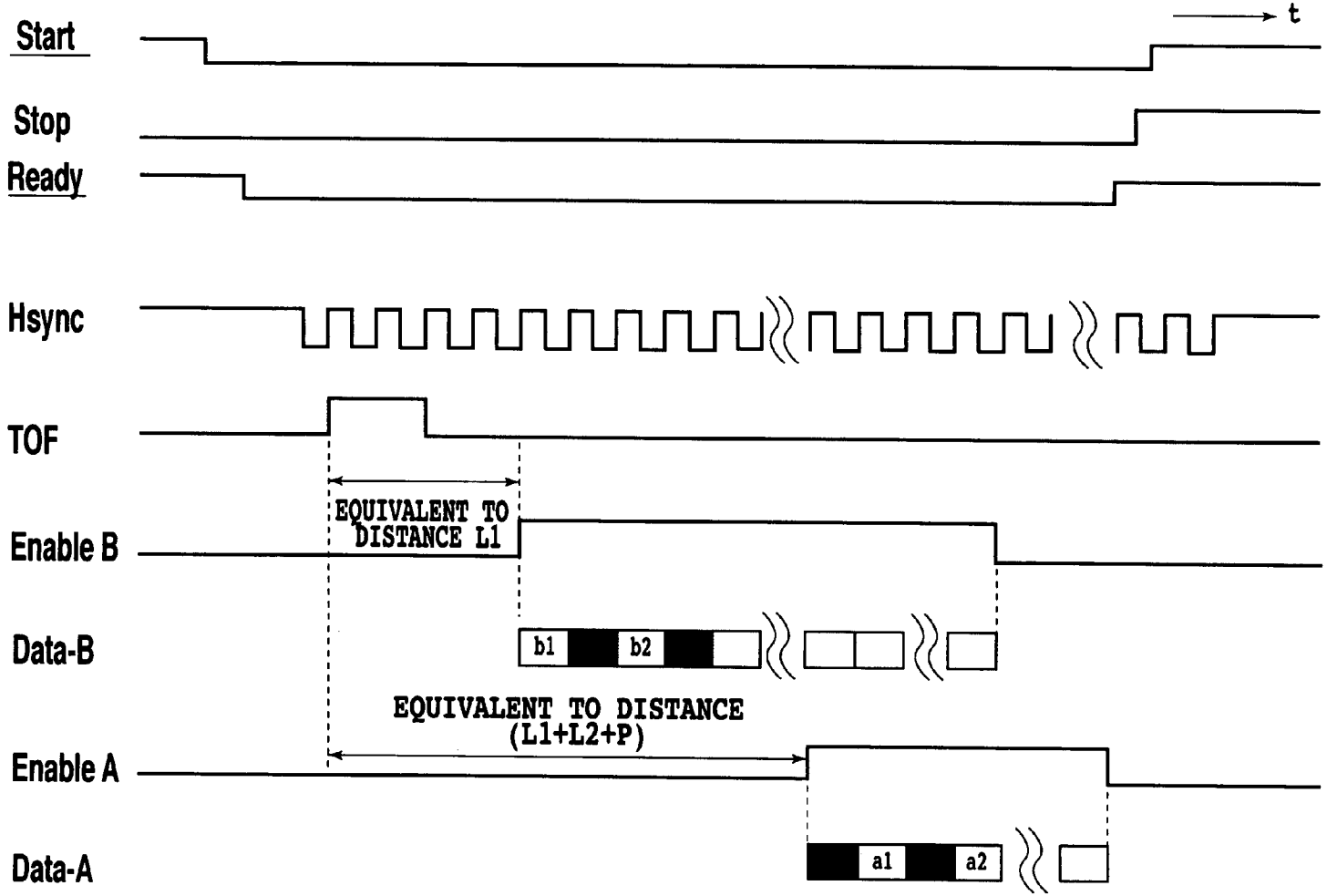
FIG. 9 is a timing chart to explain a printing operation performed during the high-speed print mode of the printing apparatus of FIG. 1.

Next, a printing operation will be explained by referring to the time chart of FIG. 9.

When an operator issues a print start command, the Start signal becomes active (goes low). Upon receiving this signal, the printer units 10, 11 move their print heads to the predetermined printing positions by the printer control units 8, 9, after which the printer units return the Ready signal to the transport unit 30. When it receives the Ready signal, the transport unit 30 activates the transport motor 35 to feed the print medium 5 at a speed V for high-speed printing. The TOF sensor 34-1, when it detects the mark 42 on the print medium 5, outputs the TOF signal. The rotary encoder 34-2 outputs a signal corresponding to the transport speed of the print medium 5. The transport unit 30 sends the TOF signal and the HSYNC signal to the printer units 10, 11 through the interface 31. In this example, the resolving power of the HSYNC signal is assumed to be equal to the print resolution (with a pitch P) in the transport direction (direction of arrow A). More specifically, if the print resolution is 600 dpi, the HSYNC signal has a cycle of P=42.3 micron.

The printer control unit 9 counts the HSYNC signal from the leading edge of the TOF signal and, when the print medium 5 has moved a distance L1 of FIG. 4, issues an Enable B signal. The Enable B signal goes low when the count of the HSYNC signal reaches the number of dots of the image area 41 in the transport direction. During this time, the printer control unit 9 sends a head drive signal corresponding to the image data b1, b2, b3, . . . to the head unit 3 in synchronism with the HSYNC signal. The head drive signal corresponds to bit map data of, for example, Y data for the yellow ink. The similar operation is also performed for the head drive signals of other color inks. As described above, when a high-speed print mode is selected, the printer control unit 9 sets a drive timing of the print head in synchronism with the HSYNC signal.

In the printer control unit 8, on the other hand, when the print medium 5 has moved a distance of L1+L2+P (P=raster pitch) from the leading edge of the TOF signal, an Enable A signal goes high. The Enable A signal goes low when the count of the HSYNC signal reaches the number of dots of the image area 41 in the transport direction. During this time, the printer control unit 8 sends a head drive signal corresponding to the image data a1, a2, a3, . . . to the head unit 1 in synchronism with the HSYNC signal. The head drive signal corresponds to bit map data of, for example, Y data for the yellow ink. The similar operation is also performed for the head drive signals of other color inks. As described above, when a high-speed print mode is selected, the printer control unit 8 sets a drive timing of the print head in synchronism with the HSYNC signal.

Next, a printing process as performed by the printer units 10, 11 will be explained by referring to FIG. 10A to FIG. 10C. In this example, it is assumed that the data string a1, a2, a3, . . . and data string b1, b2, b3, . . . are head drive signals of the yellow ink print heads 1Y, 3Y. The following explanation also applies to the head drive signals for other color inks.

Figure 10B:
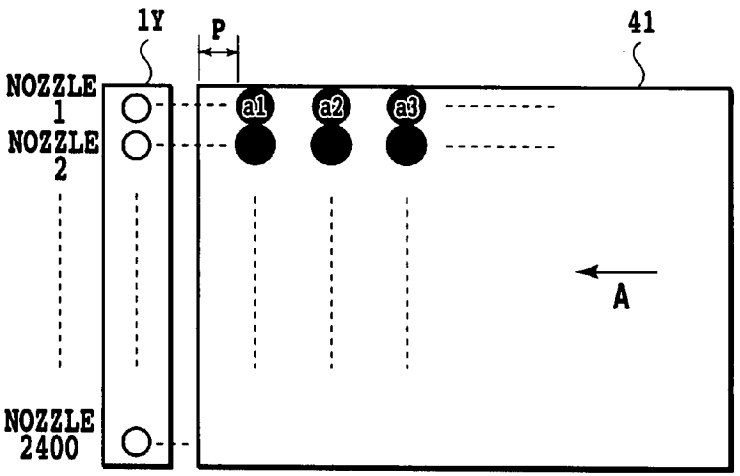
FIG. 10B is an explanatory diagram showing a printing process performed by the two printer units of FIG. 1 during the high-speed print mode.
Figure 10A:
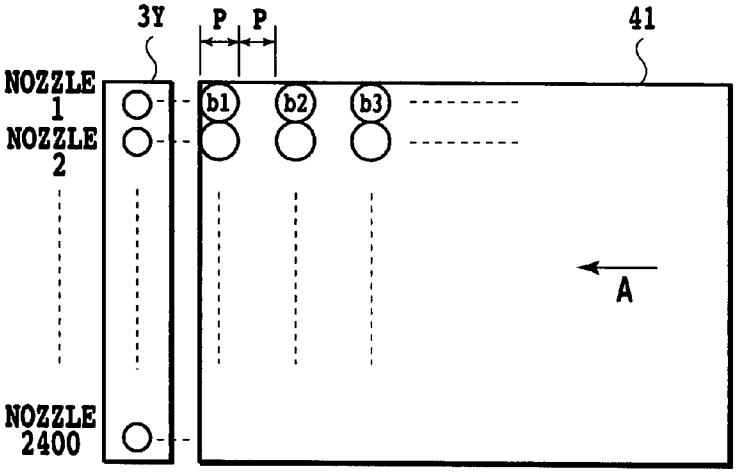
FIG. 10A is an explanatory diagram showing a printing process performed by two printer units of FIG. 1 during the high-speed print mode.

The printer control unit 9 controls the head unit 3 according to the data string b1, b2, b3, . . . to cause the print head 3Y to eject a yellow ink from its nozzles in synchronism with the HSYNC signal, as shown in FIG. 10A. The positions of blank circles b1, b2, b3, . . . in FIG. 10A match the positions where ink dots are formed in the image area 41 on the print medium 5 by the ink ejected according to the data string b1, b2, b3, . . . . Between the dots in the direction of arrow A there are provided blank spaces corresponding to the pitch P.

Similarly, the printer control unit 8 controls the head unit 1 according to the data string a1, a2, a3, . . . to cause the print head 1Y to eject yellow ink from its nozzles in synchronism with the HSYNC signal, as shown in FIG. 10B. The positions of solid circles a1, a2, a3, . . . in FIG. 10B match the positions where ink dots are formed in the image area 41 on the print medium 5 by the ink ejected according to the data string a1, a2, a3, . . . . At the front end position in the direction of arrow A and between the dots in the direction of arrow A there are provided blank spaces corresponding to the pitch P.

Figure 10C:
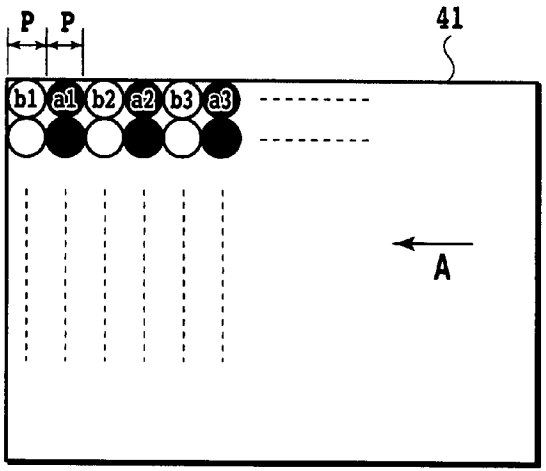
FIG. 10C is an explanatory diagram showing a printing process performed by the two printer units of FIG. 1 during the high-speed print mode.

The printing operation of the printer units 10, 11 forms dots in the image area 41 of one page according to the bit map data b1, a1, b2, a2, b3, a3, . . . as shown in FIG. 10C. The printer unit 10 forms dots a time difference (t2+1) after the printer unit 11. Because of this time difference (t2+1), a blank space corresponding to the pitch P is provided at the front end position in the direction of arrow A in FIG. 10B. In FIGS. 10A, 10B and 10C, only the data string associated with the nozzle 1 is given dot marks a1, a2, a3, . . . and b1, b2, b3, . . . . The above explanation also applies to other nozzles, nozzle 2 to nozzle 2400.

As described above, the bit map data (Y data) for the yellow ink, which is arrayed in rows extending in the transport direction of the print medium 5, is allocated one dot data at a time to the print heads 1Y and 3Y of the printer units 10, 11 alternately for printing. More specifically, the bit map data is divided into columns of raster data each extending along the nozzle column (raster division) and these raster data columns are allocated between the printer units 10 and 11 alternately. Similarly, the bit map data for magenta, cyan and black inks (M, C and K data) are also divided into columns of raster data extending along the nozzle column and these raster data columns for each color ink are allocated alternately between the print heads 1M and 3M, between the print heads 1C and 3C, and between the print heads 1Bk and 3Bk.

By using two printer units 10, 11 as described above, the layout image generated by the host PC 20 is printed in the image area 41 on the print medium 5. Since the two printer units 10, 11 alternately form dots in the transport direction of arrow A, not only can the high-speed printing be realized by setting the transport speed V of the print medium 5 high, but the high-speed printing mode can also be expected to improve an image quality dramatically because this mode is what is generally called a multipass printing operation.

[High-Density Print Mode]

Next, the operation performed when the host PC 20 sets a high-density print mode will be explained. In the high-density print mode, the print heads of the same color ink are controlled based on the same print image as described later, and their drive timings are set such that the image portions printed by these print heads overlap each other. The function unit of the drive control is also called a "high-density print mode control unit" and the function unit for setting the timing is also referred to as a "high-density print mode setting unit". These "high-density print mode control unit" and "high-density print mode setting unit" are also constructed to function as the "high-speed print mode control unit" and the "high-speed print mode setting unit" for the high-speed print mode. These units are selectively activated according to the print mode.

The transport unit 30 receives a control command for the high-density print mode through the interface 31 and, according to the control command, switches the transport speed selection means 33. The transport motor 35 is driven to feed the print medium 5 at a predetermined speed for the high-density printing (in this example, half the speed of the high-speed printing mode (V/2)).

As in the high-speed print mode described above, bit map data of FIG. 7 is generated for each color ink. That is, data string p1-1, p1-2, p1-3, . . . to be allocated to nozzle 1, data string p2-1, p2-2, p2-3, to be allocated to nozzle 2, . . . and data string p2400-1, p2400-2, p2400-3, . . . to be allocated to nozzle 2400 are generated so that they match the 4-inch print head having 2400 nozzles (nozzle 1 to nozzle 2400) that correspond to a resolution of 600 dpi. The method of allocation of the bit map data described above differs from that of the high-speed print mode.

That is, the plate data dividing program 53 divides and allocates the bit map data to the printer units 10, 11 so that the printer units 10, 11 form dots at the same positions on the print medium 5. More specifically, the data string p1-1, p1-2, p1-3, . . . for nozzle 1 is supplied parallelly to the printer units 10, 11. This data allocation also applies to the data strings for nozzle 2 to nozzle 2400. Each of the data strings is sent by the printer control program 54 to the printer control units 8, 9 of the printer units 10, 11 through the communication interface 22. The printer control units 8, 9 rasterize the bit map data of the received data string in an image memory not shown and wait for a print start command from an operator.

Figure 11:
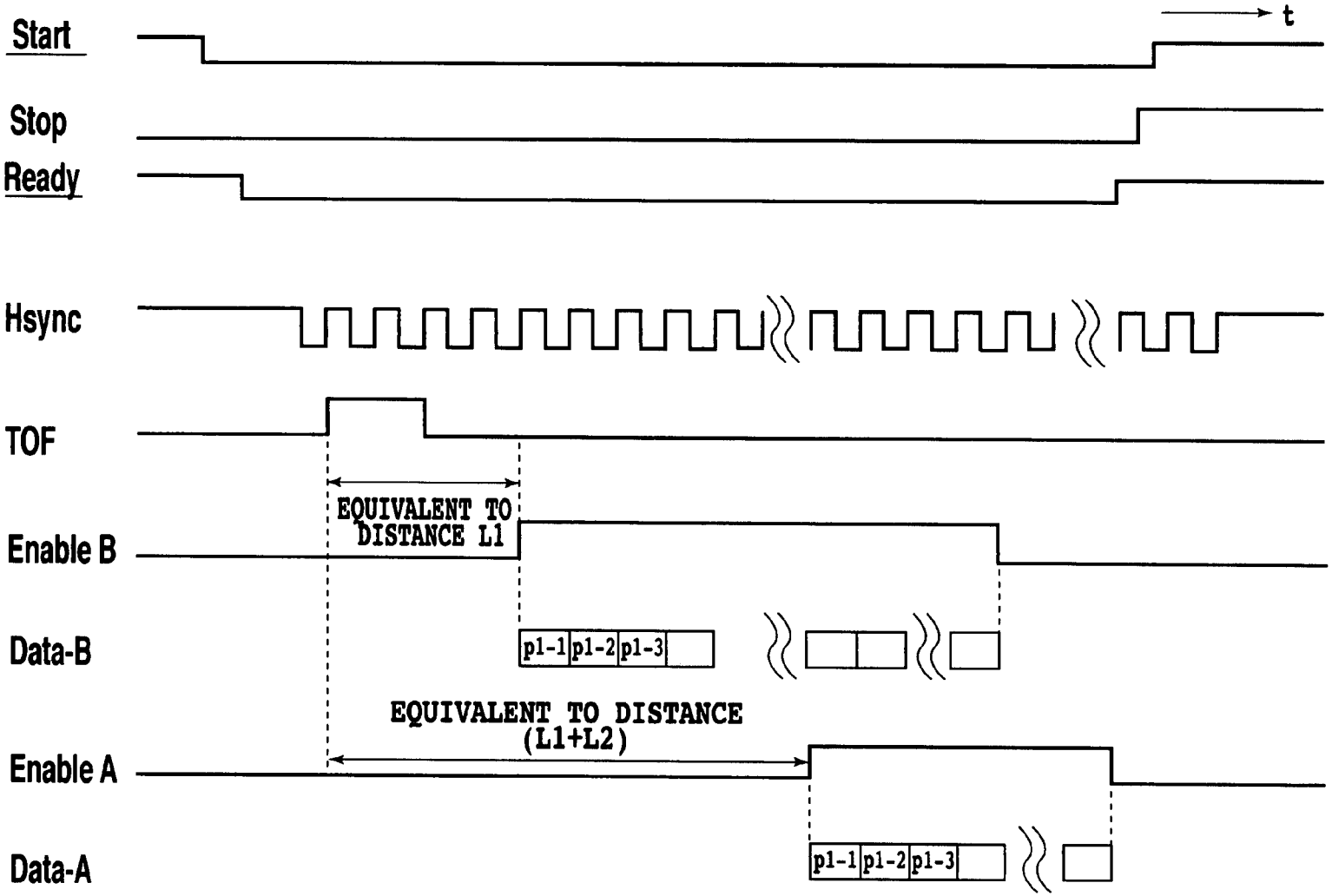
FIG. 11 is a timing chart to explain a printing operation performed during a high-density print mode of the printing apparatus of FIG. 1.

Next, a printing operation will be explained by referring to the time chart of FIG. 11.

When an operator issues a print start command, a Start signal becomes active (goes low). The printer units 10, 11 that have received the Start signal move their print heads to predetermined print positions, and then return a Ready signal to the transport unit 30. Upon receiving the Ready signal, the transport unit 30 drives the transport motor 35 to feed the print medium 5 at the transport speed V/2 for high-density printing. The TOF sensor 34-1 outputs a TOF signal when it detects a mark 42 on the print medium 5. The rotary encoder 34-2 outputs a signal representing the movement of the print medium 5. The transport unit 30 sends the TOF signal and the HSYNC signal to the printer units 10, 11 through the interface 31. In this example, the resolving power of the HSYNC signal is assumed to be equal to the dot resolution (with a pitch P) in the transport direction (direction of arrow A). More specifically, if the dot resolution is 600 dpi, the HSYNC signal has a period corresponding to P=42.3 micron. As described above, when a high-density print mode is set, the printer control unit 9 sets a drive timing of the print head in synchronism with the HSYNC signal.

The printer control unit 9 generates an Enable B signal when the print medium 5 has moved a distance L1 of FIG. 4 from the leading edge of the TOF signal. The Enable B signal goes low when the count of the HSYNC signal reaches the number of dots of the image area 41 in the transport direction. During this time, the printer control unit 9 sends a head drive signal corresponding to the image data p1-1, p1-2, p1-3, . . . to the head unit 3 in synchronism with the HSYNC signal. The head drive signal corresponds to bit map data of, for example, Y data for the yellow ink. The similar operation is also performed for the head drive signals of other color inks. In the printer control unit 8, on the other hand, when the print medium 5 has moved a distance of L1+L2 from the leading edge of the TOF signal, an Enable A signal goes high. The Enable A signal goes low when the count of the HSYNC signal reaches the number of dots of the image area 41 in the transport direction. During this time, the printer control unit 8 sends a head drive signal corresponding to the image data p1-1, p1-2, p1-3, . . . to the head unit 1 in synchronism with the HSYNC signal. The head drive signal corresponds to bit map data of, for example, Y data for the yellow ink. The similar operation is also performed for the head drive signals of other color inks. As described above, when a high-density print mode is selected, the printer control unit 8 sets a drive timing of the print head in synchronism with the HSYNC signal.

Next, a printing process as performed by the printer units 10, 11 will be explained by referring to FIG. 12A to FIG. 12C. In this example, it is assumed that p1-1, p1-2, p1-3, . . . represent a head drive signal corresponding to bit map data and that the bit map data is Y data for yellow ink.

Figure 12B:
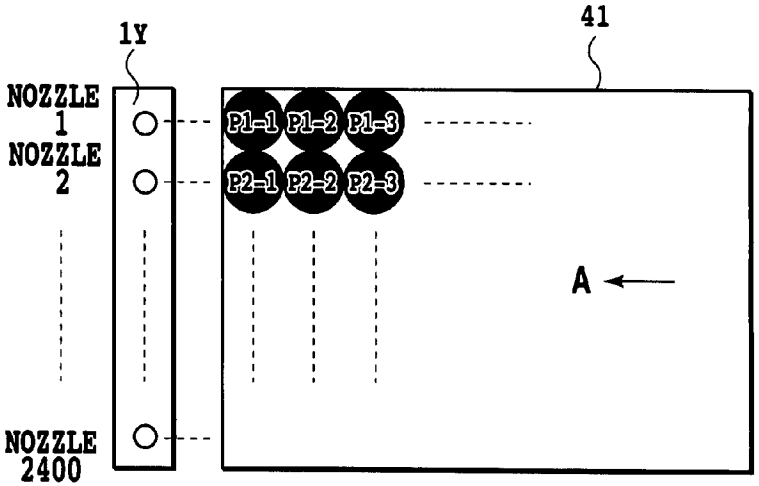
FIG. 12B is an explanatory diagram showing a printing process performed by the two printer units of FIG. 1 during a high-density print mode.
Figure 12A:
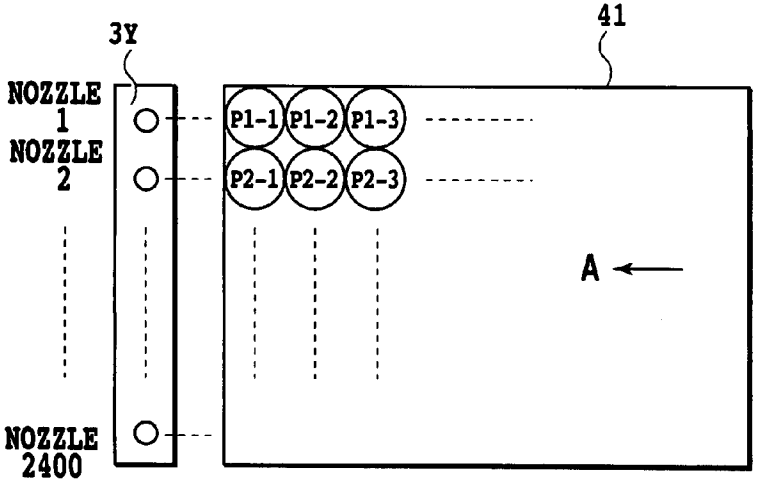
FIG. 12A is an explanatory diagram showing a printing process performed by the two printer units of FIG. 1 during a high-density print mode.

The printer control unit 9 controls the head unit 3 according to the data string p1-1, p1-2, p1-3, . . . to cause the print head 3Y to eject a yellow ink from its nozzle 1 in synchronism with the HSYNC signal, as shown in FIG. 12A. In FIG. 12A, the positions of blank circles p1-1, p1-2, p1-3, . . . match the positions where ink dots are formed in the image area 41 on the print medium 5 by the ink ejected according to the data string p1-1, p1-2, p1-3, . . . . Similarly, nozzle 2 of the print head 3Y ejects a yellow ink according to data string p2-1, p2-2, p2-3, . . . . Likewise, nozzle 3 to nozzle 2400 of the print head 3Y also eject yellow ink according to the corresponding data strings.

In a manner similar to the above, the printer control unit 8 controls the head unit 1 to cause the print head 1Y to eject yellow ink from its nozzle 1 in synchronism with the HSYNC signal, as shown in FIG. 12B. In FIG. 12B, the positions of gray circles p1-1, p1-2, p1-3, . . . (painted to distinguish them from white circles of FIG. 12A) match the positions where ink dots are formed in the image area 41 on the print medium 5 by the ink ejected according to the data string p1-1, p1-2, p1-3, . . . . Similarly, nozzle 2 of the print head 1Y ejects yellow ink according to data string p2-1, p2-2, p2-3, . . . . Likewise, nozzle 3 to nozzle 2400 of the print head 1Y also eject yellow ink according to the corresponding data strings.

Figure 12C:
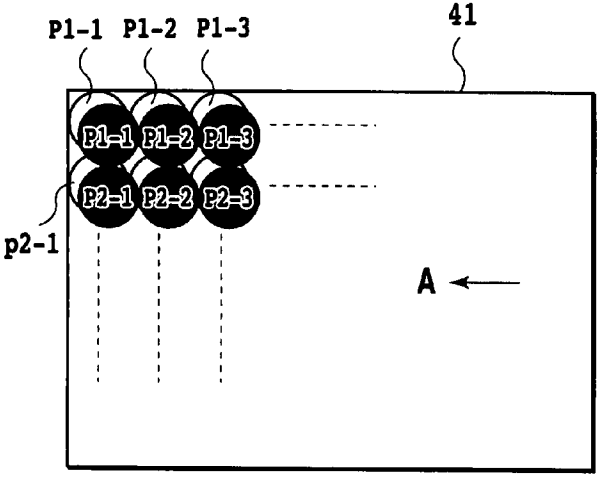
FIG. 12C is an explanatory diagram showing a printing process performed by the two printer units of FIG. 1 during a high-density print mode.

As a result of the printing operation of the printer units 10, 11 described above, two dots are formed overlapping each other at each dot position in the image area 41 of one page according to the bit map data, as shown in FIG. 12C. The printer unit 10 forms dots a time difference (t2) after the printer unit 11. FIG. 12C shows the white dots formed by the print head 3Y of the printer unit 10 slightly shifted from the gray dots formed by the print head 1Y of the printer unit 11. In a real printing, however, these dots are formed at the same positions and overlap each other.

As described above, the print heads 1Y, 3Y of the printer units 10, 11 form dots overlappingly at the same positions according to the bit map data (Y data) for yellow ink. Similarly, according to the bit map data (M, C, K data) for magenta, cyan and black ink, the print heads 1M, 1C, 1Bk of the printer unit 11 and the print heads 3M, 3C, 3Bk of the printer unit 10 form dots overlappingly at the same positions.

By using two printer units 10, 11, the layout image generated by the host PC 20 is printed in the image area 41 on the print medium 5. Since dots are overlappingly formed at the same positions by the two printer units 10, 11, a color image can be printed at a high density although the printing speed is slower than that of the high-speed print mode.

As described above, this embodiment allows an operator to select as a print mode a high-speed print mode for printing a high quality color image at high speed or a high-density print mode for printing a high density color image. In this embodiment, a single printer unit has four print heads so that images can be printed using four color inks. It is possible, however, to provide the single printer unit with a desired number of print heads corresponding to the number of ink colors so that images can be printed using one color ink or two or more color inks.

Three or more printer units may be arranged in line in the transport direction of the print medium. With an increased number of printer units, the printing speed during the high-speed print mode can be increased by distributing bit map data among the three or more printer units. Further, during the high-density print mode, the use of three or more printer units allows for a faster printing operation and for a higher density printing by overlapping three or more dots. In either print mode, dots can be formed at a higher density to print higher quality images.

Second Embodiment

Figure 13:
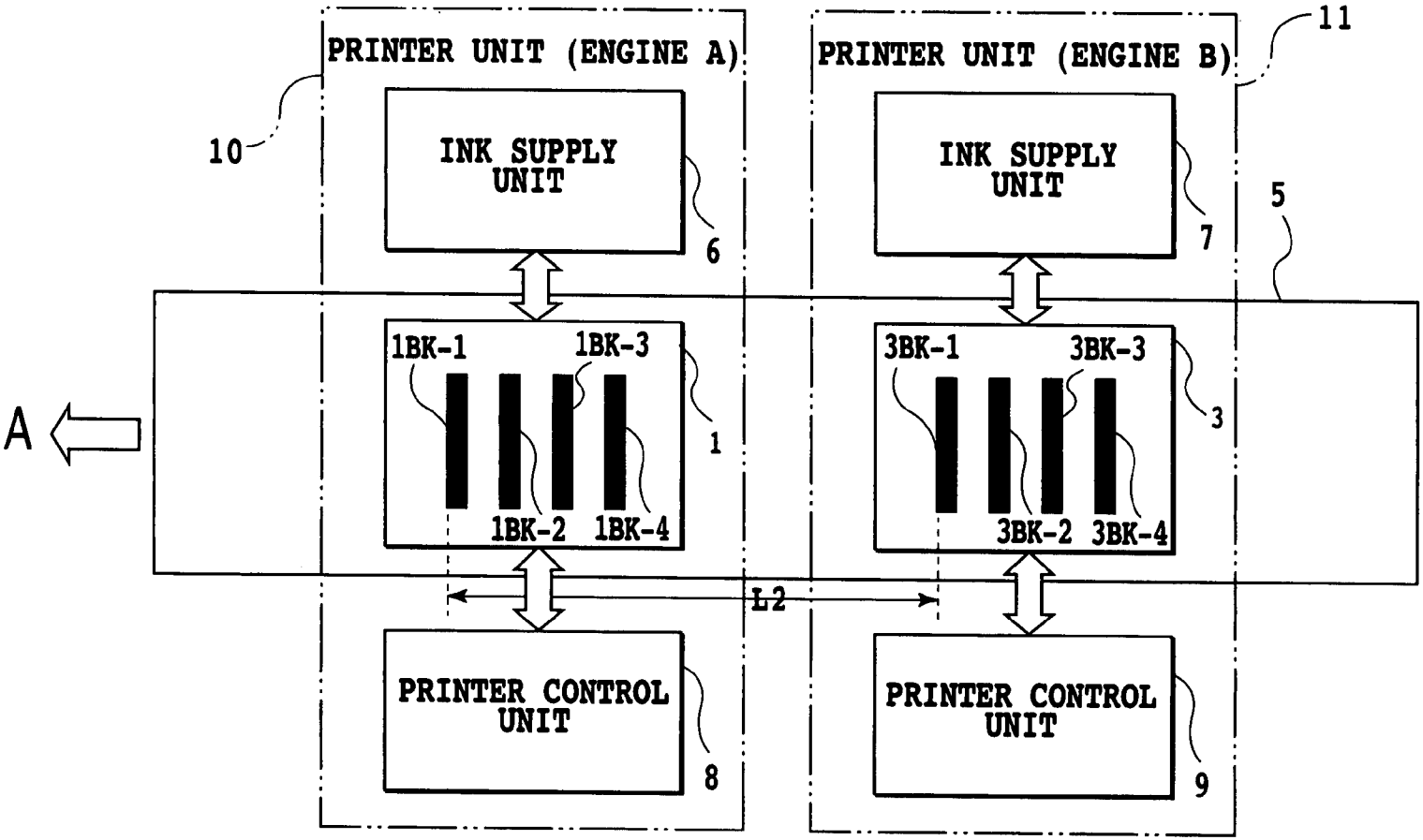
FIG. 13 is a block diagram showing an image printing unit in a printing apparatus of a second embodiment of this invention.

FIG. 13 is a block diagram of an image printing unit in a printing apparatus as a second embodiment of this invention.

In this embodiment, the head units 1, 3 in the printer units 10, 11 are each provided with four black ink print heads (1Bk-1, 1Bk-2, 1Bk-3, 1Bk-4; and 3Bk-1, 3Bk-2, 3Bk-3, 3Bk-4). The ink supply units 6, 7 are dedicated for black ink. Other configurations are similar to those of the first embodiment.

In the high-speed print mode, bit map data for black ink (B data) is divided into single columns of raster data, each extending along the nozzle column (raster division), and each raster data column is distributed among the total of eight print heads. This arrangement can make the printing speed four times faster than that of the high-speed print mode of the first embodiment in which the print data is divided and allocated to two print heads, (4V). During the high-density print mode, the print data is distributed so that two dots are overlappingly printed at one and the same position as in the first embodiment. This arrangement allows the high-density images similar to those of the first embodiment to be printed at four times the speed of the first embodiment, (2V). In this case, the data may be distributed such that the print heads 1Bk-1, 3Bk-1 form dots at the same positions according to one column of raster data of the bit map data (B data), that the print head 1Bk-2, 3Bk-2 form dots at the same positions according to the next column of raster data, that the print heads 1Bk-3, 3Bk-3 form dots at the same positions according to a third column of raster data, and that the print heads 1Bk-4, 3Bk-4 form dots at the same positions according to a fourth column of raster data. The method of data distribution is not limited to any particular method.

It is noted that the number of printer units and the number of print heads installed in one printer unit are not limited to those of this example but can be determined arbitrarily and that increasing these numbers makes faster and higher quality printing possible.

(Others)

In the preceding embodiments, during the high-speed print mode the print data to be distributed in units of raster columns to a plurality of print heads is supplied to the printing apparatus and, during the high-density print mode, the print data given to the plurality of print heads in the similar manner is also supplied to the printing apparatus. However, the print data allocated to the plurality of print heads may be distributed in ways other than those described in the above embodiments according to a plurality of print modes.

The host device (host PC) based on the software of FIG. 6 supplies print data to the printing apparatus to allocate it to a plurality of print heads according to the print mode and then controls the printing apparatus (including the sending of a Start signal). Such software may function according to programs installed from a variety of storage media or programs downloaded via the Internet. This invention includes such programs and also storage media in which these programs are stored.

The present invention has been described in detail by taking preferred embodiments for example, and it will now be apparent from the foregoing to those skilled in the art that changes and modifications may be made without departing from the invention in its broader aspects. It is the intention, therefore, in the appended claims to cover all such changes and modifications as fall within the true spirit of the invention.

What is claimed is:

1. A printing apparatus for printing an image on a print medium by mounting in the printing apparatus a plurality of ink jet print heads shifted in position from each other in a transport direction of the print medium, the print medium being transported by a transporting unit, wherein the plurality of print heads include a plurality of same color print heads capable of ejecting the same color ink, each of the plurality of same color print heads having a plurality of nozzles which are arranged in a line extending in a predetermined direction crossing the transport direction and from which the same color ink can be ejected, the plurality of print heads are divided and provided in a plurality of independent printer units which can be arranged at positions shifted from each other in the transport direction, each of the plurality of printer units comprises a memory capable of storing print data, and a printer control unit for controlling the print heads in the printer unit in which the printer control unit is comprised, the transporting unit generates a synchronization signal corresponding to a transport speed of the print medium, when a high-density print mode is set, each of the memories stores the same print data, and when the high-density print mode is set, each of the printer control units drives the print heads according to the print data stored in the memory in the printer unit, in which the printer control unit is comprised, and the synchronization signal input from the transporting unit, so that dots printed by the plurality of same color print heads overlap each other.

2. The printing apparatus according to claim 1, wherein resolution power of the synchronization signal is equal to dot resolution of the same color print head, and the printer control unit starts to count the synchronization signal from a point of time in which the print medium has passed a predetermined transporting position, and starts to drive the same color print head from a point of time in which the counted value of the synchronization signal reaches a value corresponding to a distance between the predetermined transporting position and a position where the same color print head is arranged.

3. The printing apparatus according to claim 1, wherein each of the printer units comprises an ink supply unit for supplying ink to the same color print head comprised in the printer unit.

4. The printing apparatus according to claim 1, wherein the plurality of printer units includes a plurality of sets of the same color print heads, one set for each of a plurality of color inks, when the high-density print mode is set, for each set of the same color print heads, each of the memories stores the same print data, and when the high-density print mode is set, for each of the same color print heads, each of the printer control units drives the same color print head according to the print data stored in the memory in the printer unit, in which the printer control unit is comprised, and the synchronization signal input from the transporting unit, so that the dots printed by the plurality of the same color print heads overlap each other.

5. The printing apparatus according to claim 4, wherein in each of the plurality of printer units, the print heads ejecting different inks are provided in the same order in the transport direction of the print medium.

6. The printing apparatus according to claim 4, wherein the inks ejected by the plurality of sets of the same color print heads are at least two of black, cyan, magenta and yellow inks.

7. The printing apparatus according to claim 1, wherein when a high-speed print mode is set, each of the memories stores print data allocated in units of raster columns to the plurality of same color print heads, and when the high-speed print mode is set, each of the printer control units drives the same color print head according to the print data stored in the memory in the printer unit, in which the printer control unit is comprised, and the synchronization signal input from the transporting unit, so that the dots printed by the plurality of same color print heads supplement each other to complete the image.

8. The printing apparatus according to claim 7, wherein the plurality of printer units includes a plurality of sets of the same color print heads, one set for each of a plurality of color inks, when the high-speed print mode is set, for each set of the same color print heads, each of the memories stores print data allocated in units of raster columns to the plurality of same color print heads, and when the high-speed print mode is set, for each seat of the same color print heads, each of the printer control units drives the same color print head according to the print data stored in the memory in the printer unit, in which the printer control unit is comprised, and the synchronization signal input from the transporting unit, so that the dots printed by the plurality of same color print heads supplement each other to complete the image.

9. The printing apparatus according to claim 7, wherein when the high-speed print mode is set, a transport speed of the print medium is set high in proportion to the allocation of the print data.

10. A printing system comprising:

a printing apparatus for printing an image on a print medium by mounting in the printing apparatus a plurality of ink jet print heads shifted in position from each other in a transport direction of the print medium, the print medium being transported by a transporting unit; and a host device for supplying the print data, wherein the plurality of print heads include a plurality of same color print heads capable of ejecting the same color ink, each of the plurality of same color print heads having a plurality of nozzles which are arranged in a line extending in a predetermined direction crossing the transport direction and from which the same color ink can be ejected, the plurality of print heads are divided and provided in a plurality of independent printer units which can be arranged at positions shifted from each other in the transport direction, each of the plurality of printer units comprises a memory capable of storing print data, and a printer control unit for controlling the color print heads in the printer unit in which the printer control unit is comprised, the transporting unit generates a synchronization signal corresponding to a transport speed of the print medium, when a high-density print mode is set, the host device supplies the same print data to the plurality of printer units, each of the memories stores the print data supplied from the host device, and when the high-density print mode is set, each of the printer control units drives the print heads according to the print data stored in the memory in the printer unit, in which the printer control unit is comprised, and the synchronization signal input from the transporting unit, so that dots printed by the plurality of same color print heads overlap each other.

11. A printing method for printing an image on a print medium by using a plurality of ink jet print heads shifted in position from each other in a transport direction of the print medium, the print medium being transported by a transporting unit, wherein the plurality of print heads include a plurality of same color print heads capable of ejecting the same color ink, each of the plurality of the same color print heads having a plurality of nozzles which are arranged in a line extending in a predetermined direction crossing the transport direction and from which the same color ink can be ejected, the plurality of print heads are divided and provided in a plurality of independent printer units which can be arranged at positions shifted from each other in the transport direction, and each of the plurality of printer units comprises a memory capable of storing print data, and a printer control unit for controlling the color print heads in the printer unit in which the printer control unit is comprised, the method comprising the steps of:

generating, by the transporting unit, a synchronization signal corresponding to a transport speed of the print medium;

storing the same print data in each of the memories; and driving the print heads, by each of the printer control units, according to the print data stored in the memory in the printer unit, in which the printer control unit is comprised, and the synchronization signal input from the transporting unit, so that dots printed by the plurality of same color print heads overlap each other.

12. A program embodied in a computer-readable medium for allowing a computer to execute the generating step, storing step, and driving step of the printing method as claimed in claim 11.

* * * * *